United States Patent [19]

Alford et al.

[11] 4,067,796

[45] Jan. 10, 1978

[54] TAR SANDS RECOVERY PROCESS

[75] Inventors: Harvey E. Alford, Amherst; James C. Saunders, Jr., Chesterland, both of Ohio

[73] Assignee: Standard Oil Company, Cleveland, Ohio

[21] Appl. No.: 581,317

[22] Filed: May 27, 1975

[51] Int. Cl.[2] ..... C10G 1/04

[52] U.S. Cl. ..... 208/11 LE

[58] Field of Search ..... 208/11 LE

[56] References Cited

U.S. PATENT DOCUMENTS

| | | | |
|---|---|---|---|
| 2,871,180 | 1/1959 | Lowman et al. | 208/11 LE |
| 2,885,339 | 5/1959 | Coulson et al. | 208/11 LE |
| 3,017,342 | 1/1962 | Bulat et al. | 208/11 LE |
| 3,459,653 | 8/1969 | Benson | 208/11 |
| 3,553,098 | 1/1971 | Claridge et al. | 208/11 |
| 3,553,099 | 1/1971 | Savage et al. | 208/11 |
| 3,875,046 | 4/1975 | Rosenbloom | 208/11 |

FOREIGN PATENT DOCUMENTS

| | | | |
|---|---|---|---|
| 793,812 | 9/1968 | Canada | 208/11 |

*Primary Examiner*—Delbert E. Gantz
*Assistant Examiner*—James W. Hellwege
*Attorney, Agent, or Firm*—Gwenetta Douglas Hill; Herbert D. Knudsen; Larry W. Evans

[57] ABSTRACT

The present invention is an improved process for the recovery of bitumen from tar sand by employing a vessel containing a liquid comprising an organic phase consisting of a hydrocarbon solvent which is immiscible in water and an aqueous phase. The tar sand optionally containing water is introduced into the organic phase and then subsequently passes into the aqueous phase.

6 Claims, 2 Drawing Figures

TAR SANDS RECOVERY PROCESS

BACKGROUND OF THE INVENTION

A number of processes for the recovery of bitumen from tar sand are known. A very good review of these processes is given in Kirk and Othmer *Encyclopedia of Chemical Technology,* Volume 19, pages 682–730, 1969. Dissolving bitumen in a solvent is known, but the particular method employed in the present invention is not known.

SUMMARY OF THE INVENTION

The present invention is in the process for the recovery of bitumen from tar sand comprising dissolving the bitumen in a solvent, the improvement comprising conducting the bitumen recovery in a vessel containing a liquid comprising an organic phase which contains a water immiscible hydrocarbon solvent capable of dissolving the bitumen and an aqueous phase, and processing the tar sand by introducing the tar sand into the organic phase of the liquid and subsequently conducting the tar sand into the aqueous phase. The process of the present invention gives very substantial savings in the hydrocarbon solvent and provides a spent tar sand effluent that can be readily discharged to the environment.

Broadly, the invention provides for a counter-current flow of tar sand and solvent with a very efficient method of removing the solvent from the spent tar sand. The invention is best understood by reference to the drawing.

DESCRIPTION OF THE DRAWING

Referring to FIG. 1, it is seen that tar sand is conveyed through line 10 for conditioning in conditioning vessel 12. Water enters the conditioning vessel through line 14. The sodium carbonate solution enters the conditioning vessel through line 16. From the conditioning vessel the conditioned tar sand is introduced through line 18 into the extraction vessel 20. In the extraction vessel, the bitumen is dissolved or suspended in the solvent and the sand is entrained in the water. Because the solvent is immiscible in water, it is conveniently decanted to a solvent recovery operation through line 22 into solvent recovery vessel 24. The bitumen obtained from the solvent is then taken to upgrading operations through line 26 and the solvent is recycled to the extraction vessel through line 28.

Figure 1:
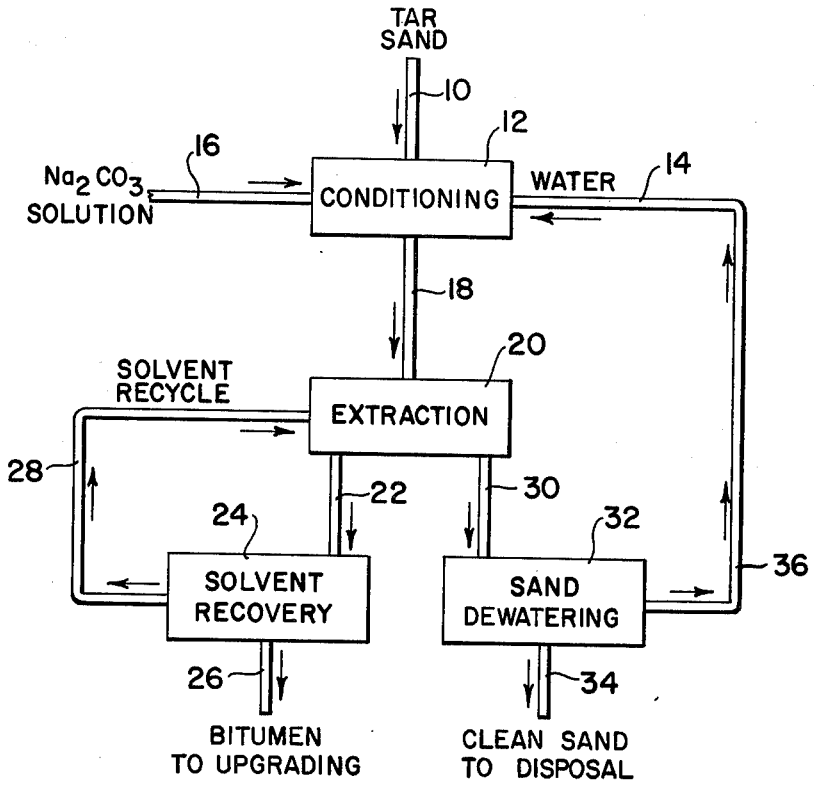
FIG. 1 shows the general processing scheme of the invention.

Separately, the aqueous phase in the extraction vessel 20 is transferred through line 30 to sand dewatering operations 32. In the sand dewatering operation, sand is removed from the water and sent to clean sand disposal through line 34. Water from this operation is sent through line 36 for recycle to the conditioning step. Of course in practice, make-up solvent and fresh water need to be added to recycles in this operation.

Figure 2:
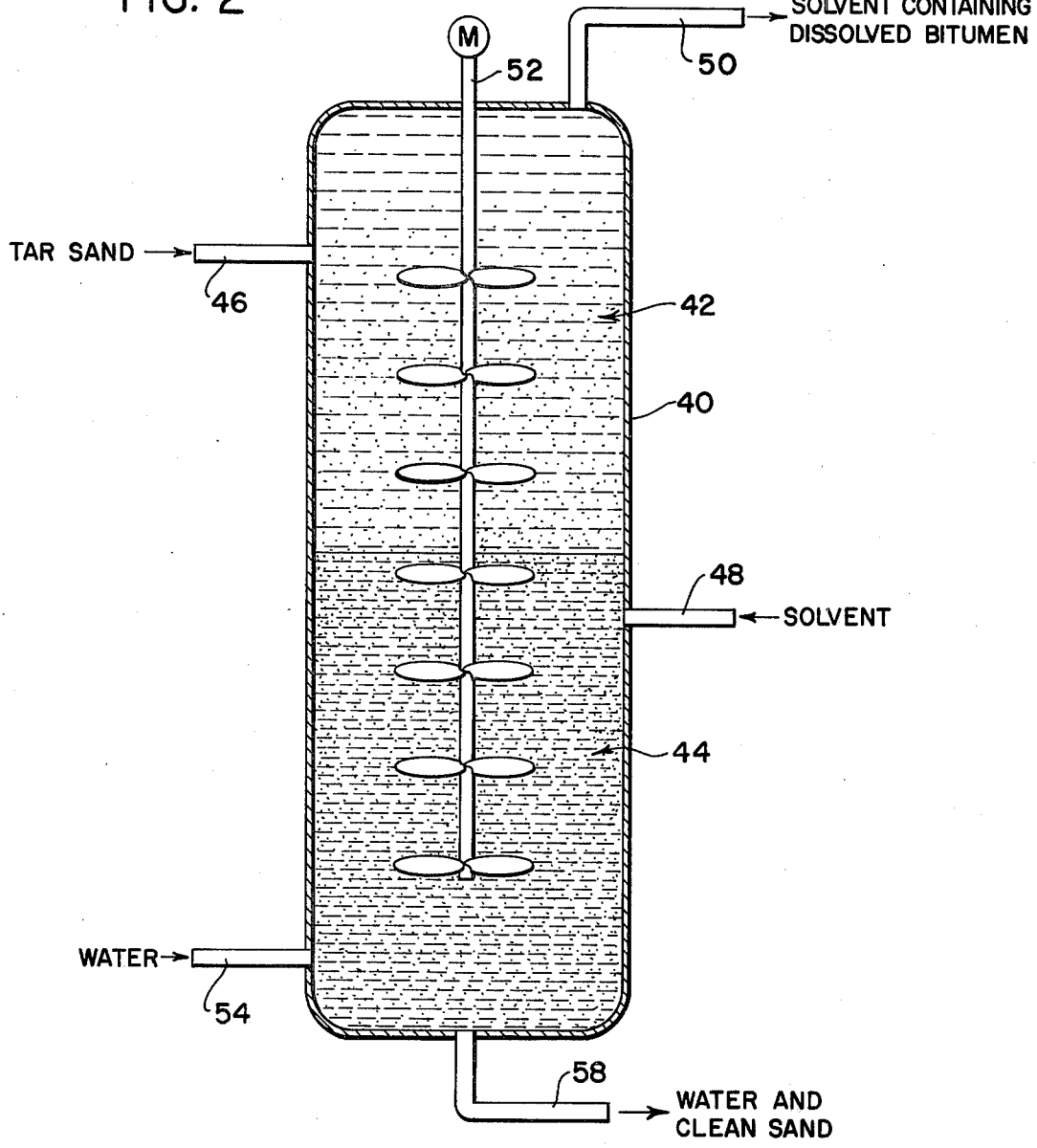
FIG. 2 shows a cross-sectional view of an extraction column used in the invention.

Referring to FIG. 2, the present invention consists of a vessel 40 containing a liquid. The liquid is present in a two-phase system. The top phase is an organic phase 42 which is composed of a water immiscible hydrocarbon solvent that is capable of dissolving bitumen. The bottom phase 44 is water. In the top part of the vessel in the organic phase 42, bitumen from the tar sand is dissolved in the solvent. In the bottom part of the vessel in the aqueous phase, the spent sand is washed to remove the organic solvent and produce a clean spent tar sand.

Tar sand which may or may not have received prior conditioning is introduced into the organic phase of the vessel through line 46. In the organic phase 42, a solvent which is introduced through line 48 dissolves or suspends the bitumen from the tar sand in the organic phase. The hydrocarbon solvent containing the bitumen is then recovered overhead through line 50. To assist in the dissolution of the bitumen and the separation of the solvent from the spent tar sand, a mixing device 52 is suitably employed.

Tar sand introduced through line 46 proceeds through the organic phase and into the aqueous phase 44. To maintain the aqueous phase at the desired height, water is introduced through line 54 and withdrawn through line 58. The organic phase 42 floats on the aqueous phase 44 because of the differences in density.

In the process of the invention, bitumen is dissolved from the tar sand and the spent tar sand is washed in the aqueous phase to yield a clean spent tar sand through line 58. This spent tar sand is dewatered and can be discharged to the environment without adversely affecting the quality of the surroundings.

DETAILED DESCRIPTION OF THE INVENTION

The present invention, as described above, is a process for the recovery of bitumen from tar sand in a vessel containing an organic phase and an aqueous phase. This provides a very efficient and convenient method of recovering bitumen from tar sand and the recovery of a clean spent sand.

The hydrocarbon solvent used in the invention must be capable of dissolving the bitumen in the tar sand and must be substantially immiscible in water. Suitable solvents that meet these requirements are well known. Of special interest in the invention is the use of kerosine, No. 2 fuel oil or water white distillate. Of course, other hydrocarbon solvents such as benzene, toluene, naphthalene and lower alkanes could also be used.

The relative amounts of the organic phase and aqueous phase of the liquid may vary widely. Any relative amount can be used so long as the bitumen is efficiently recovered and the spent tar sand obtained from the vessel is cleaned to the desired degree. Preferred in the invention are those liquid compositions that are 10 to 90% of the organic phase, with those having 25 to 75% of the organic phase being especially preferred.

The tar sand fed to the vessel may be any of the tar sands available for processing. A number of suitable tar sand deposits are well known. The tar sand may be used in the vessel of the invention in the same condition as the sand was mined, or the tar sand could be subjected to a process called "conditioning."

Conditioning of tar sand is a broad term applied to various diverse processes by which tar sand is broken up into distinct particles of bitumen and sand or minerals. One common process for accomplishing this conditioning is contacting the tar sand with an alkaline aqueous solution with heating and stirring. Any of these processes could be used on the tar sand prior to the introduction of the tar sand into the process of the invention. In the preferred practice of the invention, this prior conditioning step is employed.

Preferably, the conditioning is carried out in an aqueous medium having a pH of 6–10, at a temperature of 25° to 100° C. using less than one part by weight of water per part of tar sand. For those solvents that have greater penetrating power, this conditioning process is not as important, but in any event, the conditioning improves the bitumen recovery.

The process conditions for the process of the invention may vary widely. Substantially any temperature can be employed within the liquid range. Preferred, however, are temperatures of about 10° to 150° C. At the higher temperatures in this range, it may be necessary to apply superatmospheric pressure to the system, but higher temperatures are preferred to assist in the dissolution of the bitumen. Stirring of the reactor also assists this dissolution.

SPECIFIC EMBODIMENTS

The Vessel.

A column measuring 3.1 meters in height and having an internal diameter of 5 cm. was equipped with the following inlets, outlets and mixers. Thirteen cm. from the top of the column, a liquid product overflow outlet, 60 cm. from the top of the column an inlet for tar sand, three mixers located 1, 1.7 and 2.6 meters from the top of the column, an inlet for solvent entry at 2.8 meters and an exit port for water and spent tar sand in the bottom of the column. The hydrocarbon-water interface in the column was located 1.9 meters from the top. The water to make up the aqueous phase was introduced with the tar sand.

The Bitumen Recovery

EXAMPLE 1 — Product quality.

Tar sand containing about 8% bitumen was conditioned with water by mixing 1000 parts by weight of tar sand with 4.04 parts by weight of 10% $Na_2CO_3$ solution, 114.5 parts of fresh water and 181.5 parts of recycle water. The conditioning took place at 66° C. for five minutes with constant stirring. The conditioned tar sand was then introduced into the column described above containing water and kerosine. In addition to the tar sand slurry, 80 parts by weight of kerosine were also added. The column was operated at a temperature of 82° C.

The products from the column were 1044.5 parts of dewatered sand, 181.5 parts by weight recycle water and 154 parts of bitumen solution.

The analysis of the various products are shown in Table 1.

Table 1

Quality of Products from Tar Sand Extraction of the Invention

| Product | Product Analysis, Weight % | | | |
|---|---|---|---|---|
| | Kerosine | Bitumen | Water | Solids |
| Bitumen Solution | 49.8 | 49.8 | 0.2 | 0.2 |
| Recycle Water | 0.55 | 0.55 | 97.3 | 1.6 |
| Dewatered Sand | 0.31 | 0.31 | 11.78 | 87.6 |

It is seen from the data above that the process of the invention produces a very high recovery of bitumen from tar sand.

EXAMPLES 2–4 — Effectiveness of various solvents.

Three solvents were compared in their effectiveness for the recovery of bitumen from tar sand. The tar sand was conditioned for 15 minutes at 68° C. at a pH of 9 using a water/tar sand ratio of 0.4. Recycle water was used. In the extraction, a solvent/tar sand ratio of 0.15 was used and the column was operated at 82° C. The effect of various solvents on the hydrocarbon remaining on the sand is shown in Table 2. The results stated include the small amounts of solvent that remained on the sand.

Table 2

Effect of Various Solvents on the Recovery of Bitumen from Tar Sand

| Example | Solvent | % Original Hydrocarbon Remaining on Sand |
|---|---|---|
| 2 | #2 Furnace Oil | 55.0 |
| 3 | Water White Distillate | 43.0 |
| 4 | Kerosine | 11.8 |

EXAMPLE 5 — Effect of solvent ratio.

Using the conditions of Examples 2–4 and a solvent of water white distillate, the effect of the solvent ratio was considered. Example 3 shows 43.0% of the hydrocarbon remaining on the sand at a solvent ratio of 0.15. Reducing the solvent/tar sand ratio to 0.10, the hydrocarbon remaining on the sand was reduced to 38.6%.

EXAMPLES 6–7 — Effect of tar sand feed rate.

Tar sand was conditioned for 10 minutes at 66° C. at a pH of 8 using recycle water and a 0.3 water to tar sand ratio. Kerosine was used as the solvent in a ratio of kerosine to tar sand of 0.11. The column was operated at a temperature of 82° C. The amount of hydrocarbon remaining of the sand at two different feed rates is shown in Table 3.

Table 3

Effect of Feed Rate on Hydrocarbon Recovery

| Example | Tar Sand Feed Rate, g./hr. | % Original Hydrocarbon Remaining in Sand |
|---|---|---|
| 6 | 3,600 | 16.7 |
| 7 | 20,000 | 38.9 |

Various other experiments were run on the conditioning of the tar sand prior to use in the present invention. The tar sand recovery tended to increase as the water/tar sand ratio in the conditioning increased, with the best results being obtained at a water/tar sand ratio of 0.4. Experiments conducted on the pH indicated that a pH of about 7–8 was preferred. The experiments on the time allowed for conditioning indicated better recovery with increased time of conditioning, with the best results being obtained at a conditioning time of 15 minutes. The experiments with conditioning temperature indicated that 66° C. was preferred.

In the same manner as described above, various other solvents could be employed in the bitumen recovery process of the invention. For example, other hydrocarbon solvents could be used in the invention to separate the bitumen from tar sand.

I claim:

1. In a process for the recovery of bitumen from tar sand, wherein the bitumen recovery is conducted in a single vessel containing immiscible liquids, the improvement of:

a. conducting the bitumen recovery in a vessel containing a top liquid phase and a bottom liquid phase, wherein the top liquid phase is an organic phase which consists of a water immiscible hydrocarbon solvent capable of dissolving the bitumen, and wherein the bottom liquid phase is an aqueous phase;

b. conditioning the tar sand with an aqueous medium having a pH of 6–10, at a temperature of 25° C to 100° C, using less than one part by weight water per part tar sand, such that the tar sand is broken into distinct particles of bitumen and sand, said tar sand being conditioned prior to its introduction into the vessel;

c. processing the tar sand of step (b) by introducing the tar sand into said hydrocarbon solvent, at a temperature of 110° C to 150° C, wherein the bitumen from the tar sand is dissolved, with the spent tar sand then proceeding to the aqueous phase.

2. The process of claim 1 wherein the organic phase in the vessel is 10 to 90% by volume of the two liquid phases.

3. The process of claim 1 wherein the organic phase is 25 to 75% by volume of the two liquid phases.

4. The process of claim 1 wherein the hydrocarbon solvent is kerosine, No. 2 fuel oil or water white distillate.

5. The process of claim 1 wherein the hydrocarbon solvent is kerosine.

6. The process of claim 1 wherein the tar sand during step (c) is agitated by means consisting of mechanical mixing means.

* * * * *